US010360788B2

(12) United States Patent
Melfi et al.

(10) Patent No.: US 10,360,788 B2
(45) Date of Patent: Jul. 23, 2019

(54) OPTICAL STRAP TAMPER DETECTION WITH FOCUSING LENS

(71) Applicant: ATTENTI ELECTRONIC MONITORING LTD., Tel Aviv (IL)

(72) Inventors: Nicholas A. Melfi, Holiday, FL (US); James H. Harper, Brooksville, FL (US); Richard D. Bolduc, Clearwater, FL (US)

(73) Assignee: ATTENTI ELECTRONIC MONITORING LTD, Tel Aviv (IL)

( * ) Notice: Subject to any disclaimer, the term of this patent is extended or adjusted under 35 U.S.C. 154(b) by 0 days.

(21) Appl. No.: 15/742,927

(22) PCT Filed: Jul. 7, 2016

(86) PCT No.: PCT/US2016/041281

§ 371 (c)(1),
(2) Date: Jan. 9, 2018

(87) PCT Pub. No.: WO2017/011261

PCT Pub. Date: Jan. 19, 2017

(65) Prior Publication Data

US 2018/0365972 A1 Dec. 20, 2018

Related U.S. Application Data

(60) Provisional application No. 62/190,814, filed on Jul. 10, 2015.

(51) Int. Cl.

| | |
|---|---|
| ***G08B 29/04*** | (2006.01) |
| ***G08B 21/22*** | (2006.01) |
| ***G08B 21/18*** | (2006.01) |

(52) U.S. Cl.
CPC ..... *G08B 29/046* (2013.01); *G08B 21/182* (2013.01); *G08B 21/22* (2013.01)

(58) Field of Classification Search
CPC ..... G08B 21/0286; G08B 21/0288; G08B 21/18; G08B 21/182; G08B 21/185; G08B 21/22; G08B 29/02; G08B 29/04; G08B 29/046; G08B 29/08; D07B 1/14; D07B 1/148
See application file for complete search history.

(56) References Cited

U.S. PATENT DOCUMENTS 5,650,766 A * 7/1997 Burgmann ..... G08B 21/22 200/DIG. 2
2003/0174059 A1* 9/2003 Reeves ..... G08B 21/22 340/573.4

(Continued)

*Primary Examiner* — Van T Trieu
(74) *Attorney, Agent, or Firm* — Soroker Agmon Nordman

(57) ABSTRACT

A tamper detection monitoring apparatus and body. The monitoring apparatus includes a housing (14) having a first (15) and second (16) side, a light detector and a first connector (15*a*) on the first side, and a light emitter and a second connector (16*a*) on the second side. The monitoring apparatus further includes a strap (12) having a first end for coupling to the first connector and a second end for coupling to the second connector, wherein the strap contains an optical fiber. The monitoring apparatus further includes a first focusing lens disposed between the light detector and the first end of the strap and a processor configured to measure the variation in light received by the light detector.

9 Claims, 3 Drawing Sheets

(56) References Cited

U.S. PATENT DOCUMENTS

| | | | | |
|---|---|---|---|---|
| 2009/0051562 | A1* | 2/2009 | Potter | G08B 21/0286 340/693.5 |
| 2009/0109633 | A1* | 4/2009 | Rajala | G01S 1/042 361/726 |
| 2010/0328063 | A1* | 12/2010 | Derrick | G01S 5/0054 340/539.13 |
| 2015/0098077 | A1* | 4/2015 | Findlay | G01K 11/32 356/73.1 |

* cited by examiner

OPTICAL STRAP TAMPER DETECTION WITH FOCUSING LENS

TECHNICAL FIELD

The present disclosure relates to an electronic monitoring device for monitoring an individual, and particularly to detecting occurrences of tamper related to the electronic monitoring device.

BACKGROUND

Electronic monitoring devices are used by many government and private entities to detect and monitor the location of individuals wearing or associated with an electronic monitoring device. Electronic monitoring devices provide a cost effective solution to overcrowding of jails or prisons, and are often used to allow non-violent offenders to transition to society during a parole period, after being incarcerated for a period of time. Such devices can ensure confinement of the offender or monitored person to a particular location, such as at the offender's place of residence or at a rehabilitating institution, and may also determine whether the individual enters any places he is not allowed, also referred to as exclusion zones.

Electronic monitoring devices typically use either radio frequency (RF) communication with a second device, or Global Positioning System (GPS) technology to confirm the location of a monitored person, either in an absolute sense as with GPS, or relative to the second device which the electronic monitoring device is in RF communication with. For the purpose of knowing where the monitored person is, electronic monitoring devices are often designed to be attached to a monitored person for monitoring the movements or other activities of the person. Such electronic monitoring devices often include a tamper sensor for sensing tampering with the device or removal of the device from the person to whom the device was attached. The electronic monitoring device may then produce a tamper signal which is transmitted to an external receiver.

A variety of methods are used to detect whether a monitoring device has been removed from a monitored offender's limb. For example, U.S. Pat. No. 5,471,197 to McCurdy et al. describes a personnel monitoring apparatus, including a strap with an optical fiber in the strap for optically coupling to an optical emitter and detector in the monitoring device. A comparator compares the optical signal and a reference signal.

Even in light of these methods of detecting tamper, advancements in this area would be welcomed.

SUMMARY

One challenge with current products including an optical fiber in a strap for detecting tamper or removal of the strap is that, in some instances, the strap can be pulled away from a connector or attachment apparatus securing the strap to the monitoring apparatus while the path of light continues to reach a detector in the apparatus, such a tamper situation may not be detected by presently commercially available products.

The present disclosure provides several advantages in view of the present technical solution for detecting removal of a monitoring apparatus. The present disclosure includes a focusing lens incorporated into the monitoring apparatus to focus light transmitted through the optical fiber in the strap to a point near a light detector, or to a point near the optical fiber in the strap, thus reducing or eliminating the ability of the light detector to detect the light transmitted through the optical fiber in the instance the strap is removed from the monitoring apparatus. The present disclosure also decreases overall device power consumption. The focusing lens allows a lower intensity of light to be transmitted through the optical fiber and effectively detected by a light detector at the other end of the optical fiber. The decreased amount of light transmitted reduces power consumption by at least the light emitter and in turn increases battery life for the device, reducing the frequency with which the battery needs to be charged.

In one instance, the present disclosure includes a tamper detection monitoring apparatus. The monitoring apparatus includes a housing having a first and second side, a light detector and a first connector on the first side of the housing, and a light emitter and a second connector on the second side of the housing. The monitoring apparatus further includes a strap having a first end for coupling to the first connector and a second end for coupling to the second connector, wherein the strap contains an optical fiber. The monitoring apparatus further includes a first focusing lens disposed between the light detector and the first end of the strap and a processor configured to measure the variation in light received by the light detector.

In another instance, the present disclosure includes a tamper detection monitoring apparatus body. The body includes a housing having a first and second side, a light detector and a first connector on the first side of the housing, and a light emitter and the second connector on a second side of the housing. The housing further includes a first focusing lens disposed in the first connector; a second focusing lens disposed in the second connector; and a processor configured to measure the variation in light received by the light detector.

In some instances, the focusing lens focuses light transmitted through the optical fiber at a point near the light detector.

In some instances, if the variation in light exceeds a predetermined threshold, the processors creates an alert. In some instances, the apparatus then transmits the alert to a central monitoring station.

In some instances, the monitoring apparatus further comprising a second focusing lens disposed between the light emitter and second end of the strap.

In some instances, the monitoring apparatus further comprises an RF transceiver.

In some instances, the monitoring apparatus further comprises a GPS module.

In some instances, the monitoring apparatus further comprises a cellular modem.

In some instances, the variation in light is measure in lumens.

In some instances, the light emitted is emitted in a random pattern of light.

In some instances, at least one of the first connector and the second connector is an integral part of the housing.

In some instances, the first focusing lens is disposed in or attached to the housing.

In some instances, the first focusing lens is disposed in the strap.

BRIEF DESCRIPTION OF DRAWINGS

The following figures provide illustrations of the present invention. They are intended to further describe and clarify the invention, but not to limit the scope of the invention.

Like numbers are generally used to refer to like components. The drawings are not to scale and are for illustrative purposes only.

DETAILED DESCRIPTION

Figure 1:
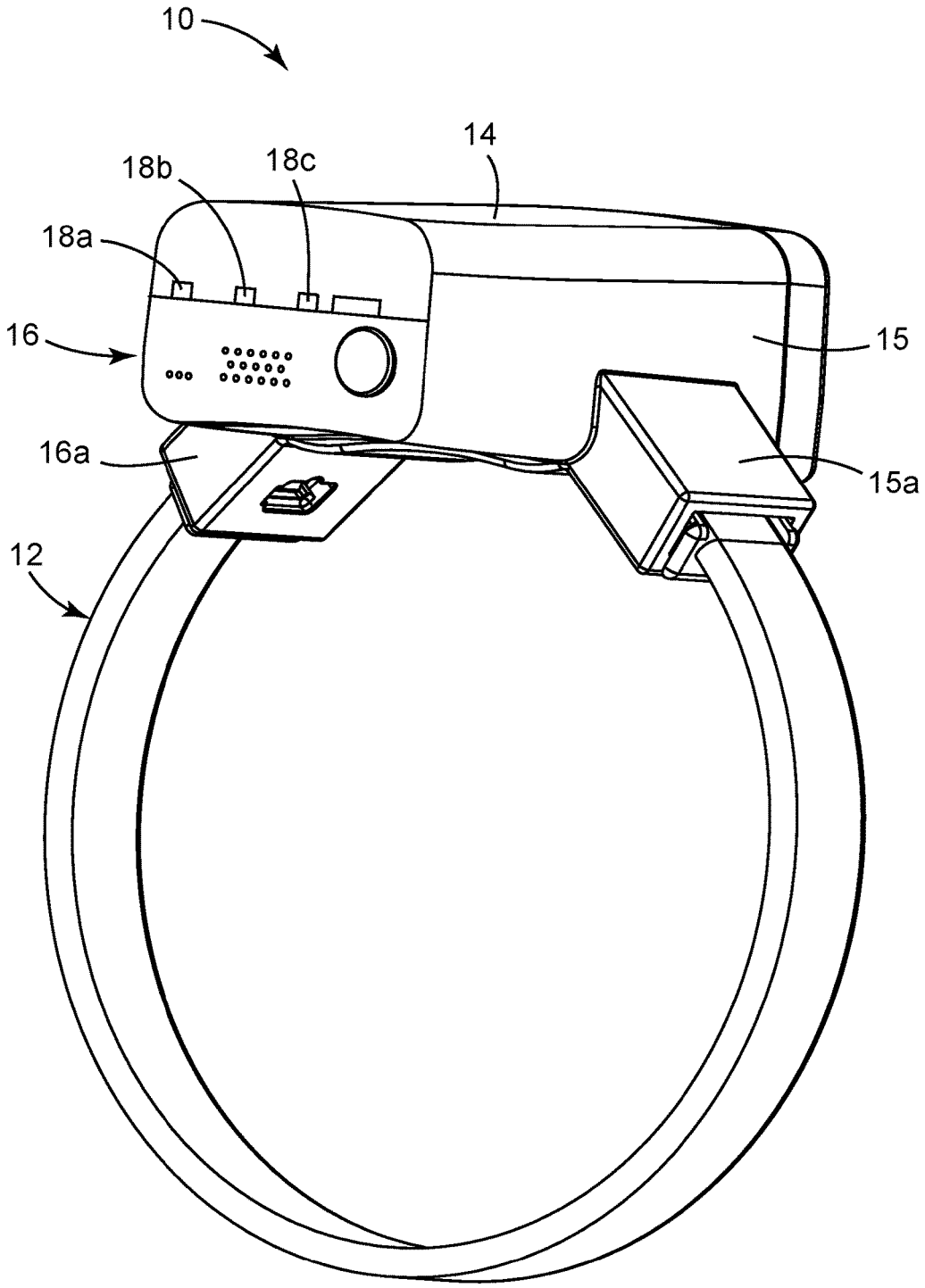
FIG. 1 is a tamper detection monitoring apparatus, including a strap.

FIG. 1 is a tamper detection monitoring apparatus 10, including a strap 12. Monitoring apparatus 10 includes a housing 14 having a first side 15 and second side 16. First side 15 has first connector 15a and second side 16 has a second connector 16a. First connector 15a and second connector secure strap 12 to housing 14. Strap 12 includes an optical fiber. Housing 10 also includes a light emitter and a light detector. Light emitter and light detector are located such that they can emit and detect light, respectively, that travels through an optical fiber in the strap 12.

Housing 14 can be made of a variety of materials. In this instance, housing 14 is made of a type of plastic, which can have the advantages of being waterproof, durable, chemically resistant, impact resistant and insulative. Housing 14 is used to enclose electronic components, a battery, and other components, and is ultrasonically welded, chemically welded with adhesive or otherwise sealed shut to prevent or reduce damage from water or tamper from a wearer of monitoring apparatus 10. Housing 14 is designed to mate with a portable battery for purposes of recharging an internal battery in housing 14 of monitoring apparatus 10. Such a configuration is described in further detail in U.S. Pat. No. 7,701,171 to Defant et al., incorporated herein by reference. Housing 14 can also include exposed charging contacts (not shown) to allow the battery in monitoring apparatus 10 to be recharged.

While housing 14 may include a variety of components, in particular, it may contain a radio frequency (RF) transceiver. In some instances housing 14 may contain a Global Positioning Satellite (GPS) module including a GPS antenna or receiver. In some instances, housing 14 may contain a cellular modem.

Housing 14 may include other types of communication or location technologies. For example, other location technologies, such as use of WIFI, zigbee or other technologies that will be apparent to one of skill in the art upon reading the present disclosure, such as Bluetooth communication, radio communication and use of dead reckoning by a multi-axis sensor to determine location.

Housing 14 includes indicators 18*a*, 18*b* and 18*c*. Indicators 18*a*, 18*b* and 18*c* provide information related to the status of the monitoring apparatus 10 to a person wearing the device or other individuals. For example, any of indicators 18*a*, 18*b* and 18*c* may be used to indicate battery power level (PWR), GPS connectivity (GPS) and an exclusion zone violation (ZONE) in those While these are examples of uses for indicators 18*a*, 18*b* and 18*c*, any of the respective indicators may be used to provide information to a user about any of the device parameters listed above, or any other device parameters which may be important to or relevant to a user. Indicators 18*a*, 18*b* and 18*c* are light emitting diodes (LED's) controlled by electronics, such as a processor, within housing 14. Other types of indicators or a user interface may be included in monitoring apparatus 10 to provide information to or communicate with a person wearing monitoring apparatus 10. For example, monitoring apparatus 10 may include a speaker and/or a microphone to allow voice communication between a person wearing monitoring apparatus 10 and another individual. Monitoring apparatus 10 may further include a display on which it displays information, such as information related to device status or parameters, an alarm that creates an audible alarm sound to indicate information such as presence in an exclusion zone, or other types of interface components as will be apparent to one of skill in the art upon reading the present disclosure.

First connector 15*a* and second connector 16*a*, as shown in FIG. 1, are an integral part of housing 14 such that they are made of the same component as housing 14 or appear as a feature of housing 14. In some instances, one connector may be an integral part of housing 14. Alternately, connectors may be separately manufactured components from housing 14 and affixed to housing 14 through any method, including welding, using adhesive, mechanically attaching connectors, or any method that will be apparent to one of skill in the art upon reading the present disclosure. Connectors 15*a*, 16*a* are configured to receive the ends of strap 12 and secure strap 12 to housing 14, so that monitoring apparatus 10 can be secured to a limb of a monitored person. Connectors may work in connection with other components, such as a pin tray or clip, to secure strap 12 to a connector.

Monitoring apparatus 10 further includes at least one focusing lens (not shown in FIG. 1). A focusing lens is a transmissive optical device that affects the focus of a light beam through refraction. Specifically, a focusing lens is used to focus light to a focal point. In some instances, focusing lens may be a spherical lens, a lens having at least two opposing surfaces where each surface is a part of the surface of a sphere. The lens may be biconvex (each surface bulges outwards from the lens) or plano-convex (one surface bulges outwards from the lens, and one surface is flat). A focusing lens may have other constructions as will be apparent to one of skill in the art upon reading the present disclosure. A curved surface on a focusing lens may approximate a surface of a sphere or may have a different shape. For example, a focusing lens may be a Fresnel lens. Any type of focusing lens may be used consistent with the scope of the present disclosure.

A focusing lens may be disposed in a variety of ways. For example, it may be disposed in or attached to the housing. In some instances the focusing lens may be disposed in the strap. A focusing lens may be generally located between the light detector and the optical fiber in strap 12. A focusing lens may be disposed between the light emitter and the optical fiber in strap 12.

Monitoring apparatus may include a first focusing lens disposed between the light detector and the optical fiber in strap 12 and a second focusing lens disposed between the light emitter and the optical fiber in strap 12. A focusing lens disposed near the light emitter serves to accumulate or focus light transmitted from the light emitter to a focal point at or near one end of the optical fiber in strap 12 to increase the intensity of light transmitted through the optical fiber. A focusing lens disposed near the light detector may serve to accumulate or focus light transmitted through the optical fiber in strap 12 and received by light detector to a focal point at or near the light detector to increase the intensity of light received by the light detector.

Light focused by the lens diverges past the focal point such that the light becomes less intense with increased distance from the focal point and from the lens. The location of the focal point in relation to the lens can vary based on the focal length of the lens. For example, in one embodiment, a focal point may be about 1 mm from the surface of the lens. In another embodiment, the focal point may be about or less than 1.5 mm from the surface of the lens. In another instance, the focal point may be about or less than 2 mm from the surface of the lens. The focal point may also be about or less than 3, 4, 5, 7 or 10 mm from the surface of the lens. The focal point may be more than 10 mm from the surface of the lens.

In this configuration, if the strap containing the optical fiber is dislodged or pulled away from the lens, the optical receives and transmits less intense light due to light divergence beyond the focal point, or the optical fiber transmits less light to the light detector, thus triggering an alarm indicating tamper.

Light emitter and light detector interface with processor in housing 14. Monitoring apparatus 10 measures variation in light received by the light detector using a processor in one configuration. Other configurations for measuring variation in light received by the light detector are within the scope of the present disclosure. In some instances, a processor may be part of the light emitter or light detector.

In some instances, if the variation in light exceeds a predetermined threshold, the processors creates an alert. Variation in light can be measured in a variety of ways. For example, it may be measured in lumens, scalar value, or output per lumens. In some instances, if the variation in light exceeds a predetermined threshold, the apparatus then transmits the alert to a central monitoring station.

In some instances, the light transmitted through the optical fiber in the strap is emitted by the light emitter in a random pattern. The pattern can be generated by the processor, transmitted through the optical fiber by the light emitter, and detected by the light detector. The processor, interfacing with the light detector, can then determine whether the light received by the light detector is consistent with the light emitted by the light emitter to confirm that there has been no tamper to the strap. Light can be transmitted in a variety of ways. For example, a variety of wavelengths could be used consistent with the present disclosure. A variety of types of modulation can be used to transmit information or patterns through the optical fiber using light.

Figure 2:
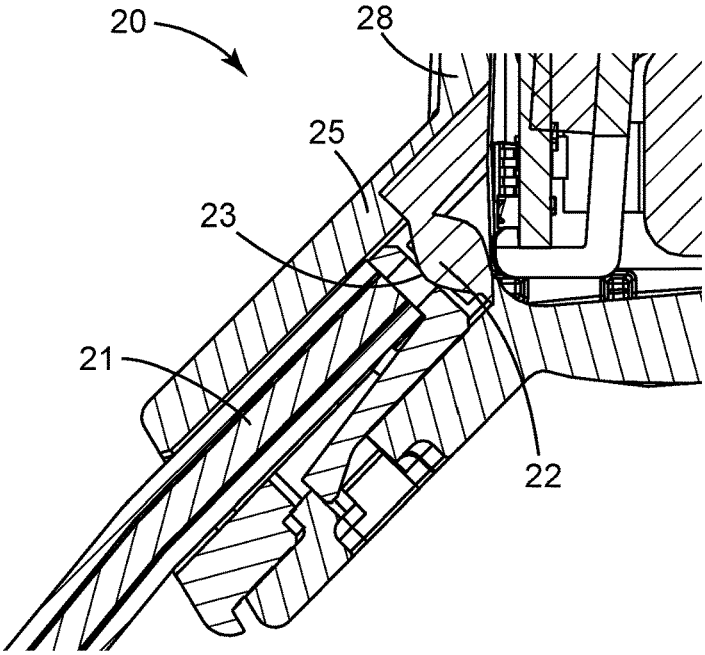
FIG. 2 is a cross section of a tamper detection monitoring body.

FIG. 2 is a cross section of a tamper detection monitoring apparatus body 20 and strap 21. In some instances, the present disclosure includes a tamper detection monitoring apparatus body. The body includes a housing 28 that houses the internal components 24 such as a radio frequency (RF) transceiver, Global Positioning Satellite (GPS) receiver or antenna, a cellular modem, a Wi-Fi transceiver, a Bluetooth transceiver and a processor.

Attachment mechanism 25 connects strap 21 to the monitoring apparatus body 20. In this illustrated instance, lens 22 is secured within attachment mechanism 25. Lens 22 focuses light transmitted or received by a light emitter or light detector at a "hot spot" or a point between the lens and the end of the optical fiber in strap 21. If the optical fiber is pulled away from the lens by an individual wearing the monitoring apparatus and attempting to remove it or otherwise tamper with it, the optical fiber not receive or transmit the light that is received or transmitted by a transmitter or an emitter, or will receive or transmit the light at a reduced level, indicating a tamper with the monitoring apparatus.

Figure 3:
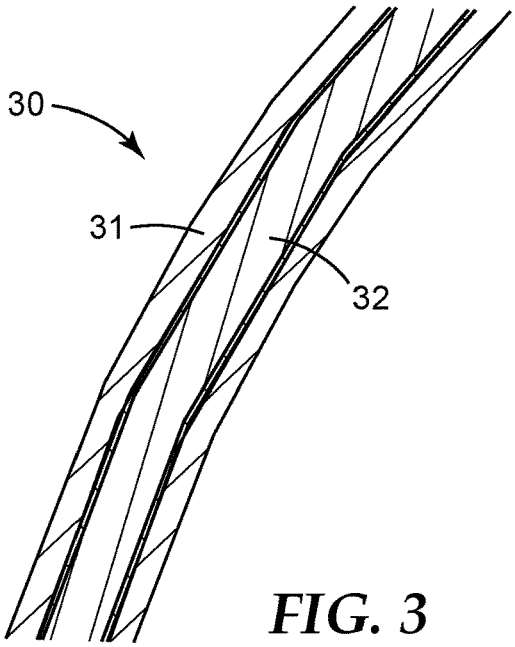
FIG. 3 is a cross section of a strap for use with a tamper detection monitoring body.

FIG. 3 is a cross section of a strap 30 for use with a tamper detection monitoring body. Strap 30 includes a semi-flexible or flexible rubber, plastic or molded outer layer surrounding an optical fiber 32. An example of a material that could be used consistent with the present disclosure is santoprene. Strap 30 may also optionally include a metal or other transmitting or reinforcing material to provide additional methods of tamper detection and reinforcement.

Figure 4:
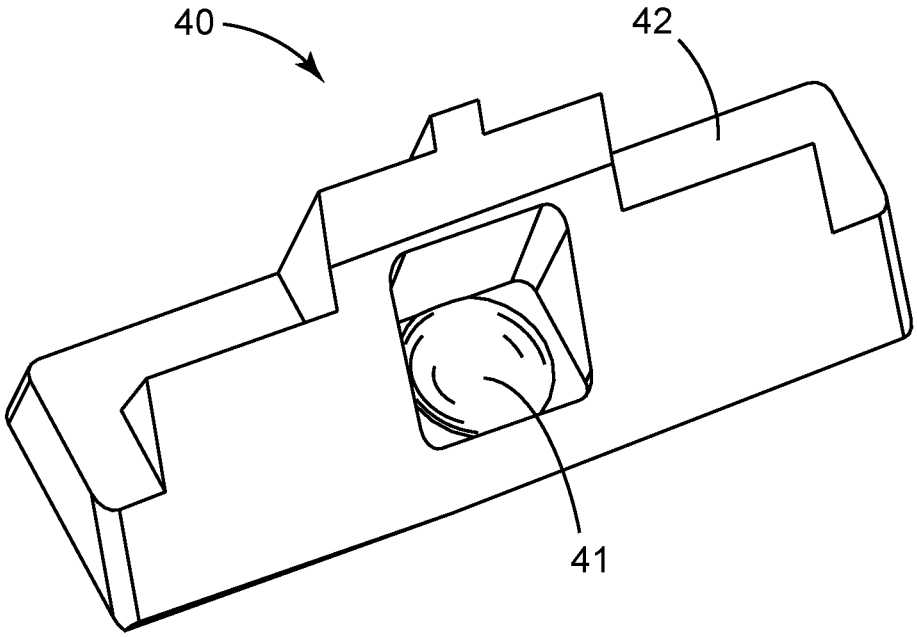
FIG. 4 is a focusing lens component.

FIG. 4 is a focusing lens component 40. Lens component 40 can be made of a single material through an injection molding process or other manufacturing process, such as casting, rotational molding, vacuum forming, machining and polishing, or may be made of multiple different materials, where the lens 41, and the surrounding features 42 are made of different materials. An example of a material that could be used for lens component 40 is a resin, such as LEXAN 121R available from Saudi Basic Industries Corporation (SABIC), headquartered in Pittsfield, Massachusetts. LEXAN 121R is a low viscosity multi-purpose grade and contains a release agent to ensure easy processing. A variety of colors can be chosen for LEXAN 121R, and one example of a color is SABIC 21092, which allows the lens component to transmit IR light, but does not allow ambient light on the visible spectrum to be passed through the material. In one instance, lens 41 and lens component 40 can act as a filter and only passes desired light wavelengths, such as wavelengths in the infrared spectrum. The material used for lens component 40 can be chosen due to its capability to transmit light, for example, light in the infrared (IR) spectrum. Using integrated or continuous component 40 that includes both the lens 41 and surrounding features 42 allows lens to be securely held in place within the monitoring apparatus and also increases the ease of manufacturing. Any material that allows light to pass through can be used for lens component 40. Other factors for material selection include bond strength between the material for lens component 40 and the remainder of the housing. Lens component 40 can be integrated into housing by inserting lens component 40 into a mold for the housing, and injecting housing material into the mold to create a molecular bond between lens material and housing material. This process is generally known as overmolding.

Figure 5:
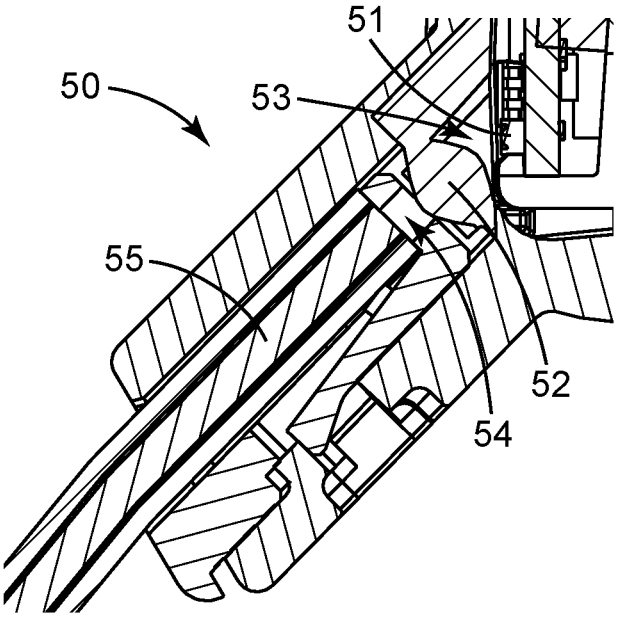
FIG. 5 shows light flow components.

FIG. 5 shows light flow components 50. Component 51 is an emitter or a detector, and serves to either emit (or transmit) or detect light. In the instance that component 51 is an emitter, light is emitted through lens 52 and is focused at a point 54 (or forms a "hot spot") on the opposite side of lens 52 from emitter 51. Point 54 is at, next to or near the end of optical fiber 55 in the monitoring device strap. This allows optical fiber 55 to transmit the focused light to the opposite end of the optical fiber 55 and to the detector.

In another instance, component 51 can be a detector. When component 51 is a detector, light is transmitted through the end of optical fiber 55 and focused by lens 52 at a point 53 (or forms a "hot spot") on the opposite side of lens 52 from optical fiber 55. Point 53 is at, next to or near the detector. This allows the detector to detect the focused light transmitted by the optical fiber 55, and increases the variation in the level of light received by the detector and as measured by the processor when the strap is pulled loose or otherwise tampered with.

Other variations on this invention will be apparent to an individual of skill in the art upon reading the present disclosure. For example, variations in the features and components housed in the monitoring apparatus are within the scope of the present disclosure. Likewise, the light detected by a detector can be measured and processed using a variety of metrics. In some configurations, the variation in light may be measured directly by the detector, and in others, it may be measured by the processor. These examples are illustrative only and intended to be non-limiting.

The method discussed in the present disclosure can be implemented on a computing device including a variety of computing functions run by a programmed processor. Computing device comprises one or more computers that include one or more processors, memory, and one or more input/output devices, such as a display screen. The computing device may also include other components and the functions of any of the illustrated components including computer, processor, memory, and input/output devices may be distributed across multiple components and separate computing devices such as in a Cloud computing environment. Computer may be configured as a workstation, desktop computing device, notebook computer, tablet computer, mobile computing device, or any other suitable computing device or collection of computing devices.

The processor may include, for example, one or more general-purpose microprocessors, specially designed processors, application specific integrated circuits (ASIC), field programmable gate arrays (FPGA), a collection of discrete logic, and/or any type of processing device capable of executing the techniques described herein. In some embodiments, memory may be configured to store program instructions (e.g., software instructions) that are executed by processor to carry out the techniques described herein. In other embodiments, the techniques described herein may be executed by specifically programmed circuitry of processor.

Memory may include any volatile or non-volatile storage elements. Examples may include random access memory (RAM) such as synchronous dynamic random access memory (SDRAM), read-only memory (ROM), non-volatile random access memory (NVRAM), electrically erasable programmable read-only memory (EEPROM), and FLASH memory. Examples may also include hard-disk, magnetic tape, a magnetic or optical data storage media, a compact disk (CD), a digital versatile disk (DVD), a Blu-ray disk, and a holographic data storage media.

EXAMPLES

Example A

Optical Strap with Focusing Lens—Emitter

To achieve an intense and well-focused light for tamper detection, a convergent or convex focusing lens was placed along the optical fiber path between a Reverse Package Infrared LED (Model: IR25-21C/TR8) light emitter obtained from Everlight Electronics Co., Ltd of Taipei, Taiwan and the strap 12 as represented in FIG. 1. The introduced light was focused onto the optical fiber path of the strap 12 which created a hot spot 2 mm from the reference plane of the lens.

Example B

Optical Strap with Focusing Lens—Detector

To achieve an intense and well-focused light for tamper detection, a convergent or convex focusing lens was placed along the optical fiber path between the strap 12 and a 1206 Package Phototransistor (Model: PT15-21B/TR8) obtained from Everlight Electronics Co, Ltd of Taipei, Taiwan as represented in FIG. 1. The introduced light was focused onto the light detector which created a hot spot 2 mm from the reference plane of the lens.

Example C

Optical Strap with Focusing Lens—Emitter & Detector

To achieve an intense and well-focused light for tamper detection, two convergent or convex focusing lenses were placed along the optical fiber path. The first was placed between a Reverse Package Infrared LED (Model: IR25-21C/TR8) light emitter obtained from Everlight Electronics Co., Ltd of Taipei, Taiwan and the strap 12 and second was positioned between the strap 12 and a 1206 Package Phototransistor (Model: PT15-21B/TR8) obtained from Everlight Electronics Co, Ltd of Taipei, Taiwan as represented in FIG. 1. The introduced light was firstly focused onto the optical fiber path of the strap 12 which created a hot spot 2 mm from the reference plane of the lens. The received light was transmitted through the optical path and was then focused onto the light detector which created a hot spot of 2 mm from the reference plane of the lens.

Example 1

A tamper detection monitoring apparatus comprising: a housing having a first and second side, a light detector and a first connector on the first side of the housing, and a light emitter and a second connector on the second side of the housing; a strap having a first end for coupling to the first connector and a second end for coupling to the second connector, wherein the strap contains an optical fiber; a first focusing lens disposed between the light detector and the first end of the strap; a processor configured to measure the variation in light received by the light detector.

Example 2

The apparatus of Example 1, wherein the first focusing lens focuses light transmitted through the optical fiber at a point near the light detector.

Example 3

The apparatus of any of Examples 1-2, wherein if the variation in light exceeds a predetermined threshold, the processor creates an alert.

Example 4

The apparatus of any of Examples 1-3, wherein the apparatus transmits the alert to a central monitoring station.

Example 5

The apparatus of any of Examples 1-4, further comprising a second focusing lens disposed between the light emitter and the second end of the strap.

Example 6

The apparatus of any of Examples 1-5, further comprising an RF transceiver.

Example 7

The apparatus of any of Examples 1-6, further comprising a GPS module.

Example 8

The apparatus of any of Examples 1-7, further comprising a cellular modem.

Example 9

The apparatus of any of Examples 1-8, wherein the variation in light is measure in lumens.

Example 10

The apparatus of any of Examples 1-9, wherein the light emitted by the light emitter is a random pattern of light.

Example 11

The apparatus of any of Examples 1-10, wherein at least one of the first connector and the second connector is an integral part of the housing.

Example 12

The apparatus of any of Examples 1-11, wherein the first focusing lens is disposed in or attached to the housing.

Example 13

The apparatus of any of Examples 1-12, wherein the first focusing lens is disposed in the strap.

Example 14

A tamper detection monitoring apparatus body comprising: a housing having a first and second side, a light detector and a first connector on the first side of the housing, and a light emitter and the second connector on a second side of the housing; a first focusing lens disposed in the first connector; a second focusing lens disposed in the second connector; and a processor configured to measure the variation in light received by the light detector.

Example 15

The apparatus of Example 14, wherein the first focusing lens focuses light transmitted through an optical fiber in a strap connected to each of the first connector and the second connector, the light being focused at a point near the light detector.

Example 16

The apparatus of any of Examples 14-15, wherein if the variation exceeds a predetermined threshold, the processor creates an alert.

Example 17

The apparatus of any of Examples 14-16, wherein the apparatus transmits the alert to a central monitoring station.

Example 18

The apparatus of any of Examples 14-17, further comprising an RF transceiver.

Example 19

The apparatus of any of Examples 14-18, further comprising a GPS module.

Example 20

The apparatus of any of Examples 14-19, further comprising a cellular modem.

Example 21

The apparatus of any of Examples 14-20, wherein the variation in light is measure in lumens.

Example 22

The apparatus of any of Examples 14-21, wherein the light emitted by the emitter is a random pattern of light.

Example 23

The apparatus of any of Examples 14-22, wherein at least one of the first connector and the second connector is an integral part of the housing.

What is claimed is:

1. A tamper detection monitoring apparatus, the apparatus comprising:

a housing having a first and second side, comprising a light detector on the first side of the housing, and a light emitter on the second side of the housing;

a strap for securing the apparatus onto a limb having a first end and a second end, comprising an optical fiber, a first focusing lens, and a second focusing lens, wherein the optical fiber is disposed in the strap from the first end to the second end with the first focusing lens positioned at the first end and the second focusing lens positioned at the second end;

a first connector for attachment to the first side of the housing and configured to receive the first end of the strap, wherein upon attaching the first connector to the first side of the housing causes light in the optical fiber to be coupled to the light detector in the housing by the first focusing lens at the first end of the strap, the light detector at an opposite side of the first focusing lens;

a second connector for attachment to the second side of the housing configured to receive the second end of the strap, wherein upon attaching the second connector to the second side of the housing causes light emitted from the light emitter in the housing to be coupled into the optical fiber by the second focusing lens at the second end of the strap, the second end of the strap at an opposite side of the second focusing lens; and a processor configured to measure the variation in light received by the light detector.

2. The apparatus of claim 1, wherein the first focusing lens focuses light transmitted through the optical fiber at a point near the light detector.

3. The apparatus of claim 1, wherein if the variation in light exceeds a predetermined threshold, the processor creates an alert.

4. The apparatus of claim 3, wherein the apparatus transmits the alert to a central monitoring station.

5. The apparatus of claim 1, wherein the light emitted by the light emitter is a random pattern of light.

6. The apparatus of claim 1, wherein the second focusing lens focuses from the light emitter onto a point near the second end of the optical fiber.

7. The apparatus of claim 1, further comprising an alarm that creates an audible alarm sound.

8. The apparatus according to claim 1, further comprising a global positioning system (GPS) module.

9. The apparatus according to claim 1, wherein the apparatus is configured to alarm an individual entering an exclusion zone.

* * * * *